United States Patent [19]

Pasbrig

[11] Patent Number: 4,509,469

[45] Date of Patent: Apr. 9, 1985

[54] BREAK IGNITION PLUG

[75] Inventor: Max Pasbrig, Orselina, Switzerland

[73] Assignee: Lacrex Brevetti S.A., Orselina, Switzerland

[21] Appl. No.: 207,455

[22] Filed: Nov. 17, 1980

[30] Foreign Application Priority Data

Dec. 21, 1979 [DE] Fed. Rep. of Germany ..... 2951848

[51] Int. Cl.[3] ..... F02P 15/00

[52] U.S. Cl. ..... 123/154

[58] Field of Search ..... 123/154, 156, 143 B, 123/143 R, 169 EB

[56] References Cited

U.S. PATENT DOCUMENTS

| | | | |
|---|---|---|---|
| 735,923 | 8/1903 | Wilson | 123/154 |
| 892,037 | 6/1908 | Felokamp | 123/154 |
| 1,389,280 | 8/1921 | Tileston | 123/154 |

*Primary Examiner*—Ronald B. Cox

*Attorney, Agent, or Firm*—Werner W. Kleeman

[57] ABSTRACT

A break ignition plug for piston engines wherein an electromagnet acts upon an armature which activates a movable electrode and an ignition pulse passes through the magnet coil of the electromagnet and a short-circuit path between the electrodes. The magnetic field which builds-up in the electromagnet causes breaking of the short-circuit path and spark formation. At the free end of blade or band springs arranged in spaced relationship from one another at the lengthwise axis of the ignition plug there are provided confronting electrode heads. The blade springs are retained at the magnet core and freely protrude by means of the electrode ends into a hollow space or chamber formed at a threaded portion of the ignition plug. At a magnet gap region of the core there are formed at the blade springs armatures which repel one another upon excitation of the electromagnet.

6 Claims, 3 Drawing Figures

BREAK IGNITION PLUG

CROSS REFERENCE TO RELATED CASES

This application is related to my commonly assigned granted U.S. Pat. Nos. 3,693,607, granted Sept. 26, 1972; 3,908,146, granted Sept. 23, 1975 and 4,172,439, granted Oct. 30, 1979.

BACKGROUND OF THE INVENTION

The present invention relates to a new and improved construction of a break ignition plug—sometimes referred to in the art as a make-and-break spark plug—for piston engines.

Generally speaking the break ignition plug of the present development is the type wherein an electromagnet acts upon an armature which activates a movable electrode and wherein an ignition pulse passes through the magnet coil of the electromagnet and a short-circuit path between the electrodes of the spark plug. The magnetic field which builds-up in the electromagnet causes a breaking or interruption of the short-circuit path while forming a spark.

With heretofore known break ignition plugs of this type, as exemplified by German Pat. No. 1,919,828 and German Pat. publication No. 2,653,226, there is provided a movable electrode and a stationary electrode. The break path of the movable electrode occurs in the direction of the spark plug axis and thus, also towards or away from the compression pressure. With these heretofore known ignition or spark plugs the construction of the pressure equalization chambers or spaces is of importance, which, in turn requires an additional expenditure. Furthermore, the inflowing pressurized gasses reduce the forces which are to be applied by the armature. With such ignition plugs there are provided a number of movable parts which are exposed to pronounced wear.

SUMMARY OF THE INVENTION

Therefore, with the foregoing in mind it is a primary object of the present invention to provide a new and improved construction of break ignition plug wherein the electrode movement is extensively independent of the pressurized gasses and, additionally, the electrode support or holder arrangement is simplified.

Now in order to implement these and still further objects of the invention, which will become more readily apparent as the description proceeds, the invention teaches a break ignition plug of the previously mentioned type wherein at the free ends of band or blade springs arranged in the lengthwise axis of the ignition plug in spaced relationship from one another there are provided confronting electrode heads. The band or blade springs are held at the magnet core and freely protrude with the electrode ends into a hollow space formed at a threaded portion of the ignition plug, and at a magnet gap region of the core there are formed armatures at the band or blade springs which are repelled from one another upon excitation of the electromagnet.

By virtue of the fact that the breaking movement of both electrodes extends transversely with respect to the ignition plug axis and to the compression pressure flow, the compression pressure no longer can influence the electrode movements, and therefore, it is also possible to beneficially dispense with the use of any pressure compensation devices. A further advantage of this ignition plug resides in the fact that the only movable parts are constituted by the band or blade springs, which move in a free space and therefore are not exposed to any friction and wear effects. The blade springs and electrode heads, with this arrangement, furthermore can be easily exchanged.

If both of the blade springs, armature plates and electrodes are constructed so as to be correlated to one another, then both of the electrode heads move through the same extent out of the starting position. On the other hand, there also exists the possibility of more or less limiting or completely eliminating the mobility of the one band or blade spring when the electrodes move through different displacement paths or one or both electrodes should in fact be immobile.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
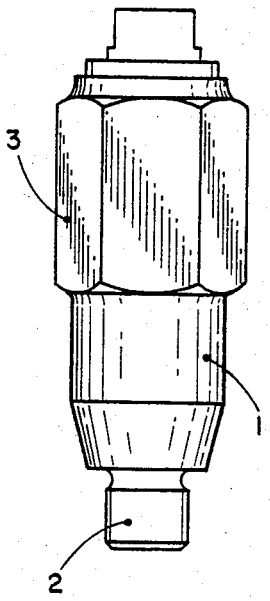
FIG. 1 is a front view of a break ignition plug constructed according to the invention.
Figure 2:
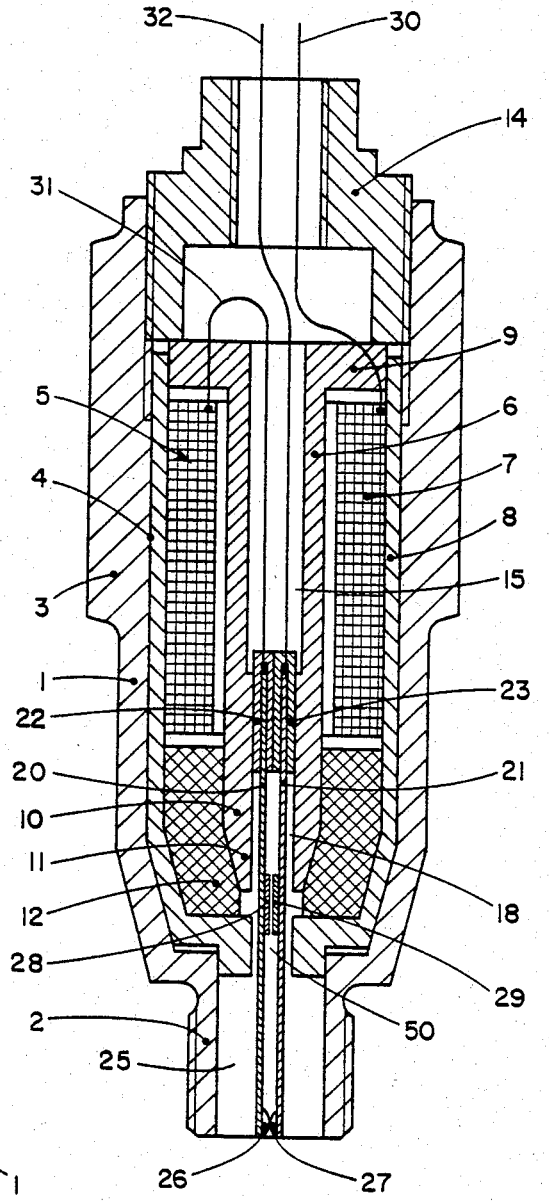
FIG. 2 is an enlarged longitudinal sectional view of the ignition plug of FIG. 1.
Figure 3:
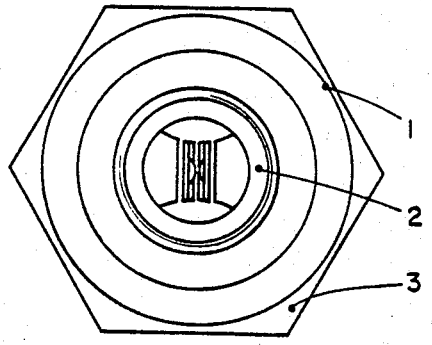
FIG. 3 is an end view of the electrode side of the ignition plug.

Describing now the drawings, the illustrated exemplary embodiment of break ignition plug will be seen to comprise an essentially cylindrical housing 1 formed of a metallic, however non-magnetizable material which tapers in the direction of the threading-in side and finally terminates at a threaded portion 2 which can be threaded into a not particularly illustated but conventional cylinder head of an internal combustion engine. The outer surface of the housing 1 can be configured at a sectional region thereof so as to possess a multi-edge profile or sectional shape 3. Within a hollow space or compartment 4 of the housing 1 there is inserted an electromagnetic pot circuit 5 formed of an iron core 6, a magnet coil 7 and a sheath or jacket 8. This pot circuit is closed at the top by a core flange 9. At the cylinder side there protrudes a core extension or prolongation 10 with its conical tip 11 into an insulating or insulation body 12 which is supported in relation to the jacket 8. This jacket 8, in turn is pressed into the constricted portion of the housing 1, so that the entire magnet set is fixedly seated within the housing 1 if there is threaded onto the end of the housing 1 facing away from the threaded portion 2 a closure head 14 or equivalent structure. The core 6 possesses a central bore or opening 15 which at the extension end 10 of the core 6 advantageously has a substantially rectangular cross-sectional configuration. Introduced into the thus formed core slot 18 are two band or blade springs 20 and 21 which are inserted at their inner ends in a respective insulation plate 22 and 23, so that the blade spring ends are electrically insulated both from one another and also in relation to the magnet core 6. These insulating plates 22 and 23 are fixedly seated with a press fit in the core slot 18, but on the other hand they allow exchange or replacement thereof. Due to retention of the band or blade springs 20 and 21 by means of the insulating plates 22 and 23 the blade springs are spaced from the core 6, so that these blade springs 20 and 21 can freely protrude into the hollow space or compartment 25 of the threaded portion 2 without contact by providing similar throughpass slots in the insulation body 12 and the jacket 8. At their free ends these bands or blade springs 20 and 21 carry a respective electrode head 26 and 27 which confront one another and in the rest position are in contact with one another. At magnet gap region 50 there are mounted armature plates 28 and 29 at the band springs 20 and 21. An ignition cable 30 is layed towards the coil 7. Leading from the magnet coil 7 is a line or conductor 31 to one of the band or blade springs 20, whereas the other band or blade spring 21 is connected with a cable 32.

The mode of operation of the described break ignition plug is as follows:

The voltage or potential of a conventional battery or the like is either stepped-up or directly infed. Depending upon the number of cylinders which are to be operated there is connected an appropriate number of firing thyristors as taught for instance in the mentioned U.S. Pat. No. 3,693,607 which on the other hand, also are connected with the break ignition plug. An ignition distributor or a timer having an ignition pulse shaper controls the thyristors in a manner such that depending upon the desired ignition sequence at the cylinder there are delivered control pulses. The ignition current energizes the electromagnet and flows also through the short-circuit path formed by the electrodes. The magnetic field which builds-up generates a magnetic action at the armature region, and the configuration of the pot circuit insures for a concentration of such magnetic action. Apart from the attraction effect which is exerted upon the blade or band springs, to the extent that such are formed of magnetizable material, as well as upon the armature, there additionally arises a repelling action between the armature due to the course of the magnetic field. The electrode heads are torn apart while forming a spark, thus, there is also interrupted the current circuit, so that the magnetic field again collapses and the electrode heads can return back into the contact position. During the breaking or tearing movement of the blade springs as previously described, there does not arise any contact of the magnet pole.

Obviously, the invention is not limited to the illustrated exemplary embodiment. Thus, for instance, with appropriate construction the blade or band springs also can serve as armature elements.

While there are shown and described present preferred embodiments of the invention, it is to be distinctly understood that the invention is not limited thereto, but may be otherwise variously embodied and practiced within the scope of the following claims.

Accordingly, what I claim is:

1. A break ignition plug for piston engines, comprising:

an electromagnet having a magnet core and magnet coil;

blade springs arranged in spaced relationship from one another at a lengthwise axis of the ignition plug;

said blade springs having free ends;

electrode heads provided at the free ends of said blade springs;

said electrode heads confronting one another;

said blade springs being retained in the magnet core;

said blade springs freely protruding with the electrode heads provided at the blade spring ends into a hollow space formed at a threaded portion of the ignition plug;

armature means formed on the blade springs at a magnetic gap region of the magnet core; and said armature means comprising armature members arranged to be repelled from one another upon excitation of the electromagnet.

2. A break ignition plug for piston engines, comprising:

an electromagnet having a magnet core and magnet coil;

blade springs arranged in spaced relationship from one another at a lengthwise axis of the ignition plug;

said blade springs having free ends;

electrode heads provided at the free ends of said blade springs;

said electrode heads confronting one another;

said blade springs being retained in the magnet core;

said blade springs freely protruding with the electrode heads provided at the blade spring ends into a hollow space formed at a threaded portion of the ignition plug;

armature means formed on the blade springs at a magnetic gap region of the magnet core;

said armature means comprising armature members arranged to be repelled from one another upon excitation of the electromagnet; and one of said blade springs constitutes a reinforced structure.

3. A break ignition plug for piston engines, comprising:

an electromagnet having a magnet core and magnet coil;

blade springs arranged in spaced relationship from one another at a lengthwise axis of the ignition plug;

said blade springs having free ends;

electrode heads provided at the free ends of said blade springs;

said electrode heads confronting one another;

said blade springs being retained in the magnet core;

said blade springs freely protruding with the electrode heads provided at the blade spring ends into a hollow space formed at a threaded portion of the ignition plug;

armature means formed on the blade springs at a magnetic gap region of the magnet core;

said armature means comprising armature members arranged to be repelled from one another upon excitation of the electromagnet; and one of said blade springs is retained in its starting position.

4. A break ignition plug for piston engines, comprising:

an electromagnet having a magnet core and magnet coil;

blade springs arranged in spaced relationship from one another at a lengthwise axis of the ignition plug;

said blade springs having free ends;

electrode heads provided at the free ends of said blade springs;

said electrode heads confronting one another;

said blade springs being retained in the magnet core;

said blade springs freely protruding with the electrode heads provided at the blade spring ends into a hollow space formed at a threaded portion of the ignition plug;

armature means formed on the blade springs at a magnetic gap region of the magnet core;

said armature means comprising armature members arranged to be repelled from one another upon excitation of the electromagnet;

said blade springs have plug-in ends;

insulating plates provided for said magnet core in which there are embedded said plug-in ends of said blade springs; and said insulating plates being inserted with a press fit into the magnet core.

5. The break ignition plug as defined in claim 1, wherein:

the magnet core contains an extension portion at the side of the electrode heads and which extention portion protrudes past the magnet coil.

6. The break ignition plug as defined in claim 1, wherein:

said armature means comprise armature plates defining said armature members; and the blade springs, the armature plates and the electrode heads are constructed to conform with one another.

* * * * *